US005550011A

United States Patent [19]

Fant et al.

[11] Patent Number: 5,550,011

[45] Date of Patent: Aug. 27, 1996

[54] PHOTOGRAPHIC ELEMENTS CONTAINING MATTE PARTICLES OF BIMODAL SIZE DISTRIBUTION

[75] Inventors: Alfred B. Fant, Rochester; Yongcai Wang, Penfield; Dennis E. Smith, Rochester; Melvin M. Kestner, Hilton; Gary W. Visconte, Rochester, all of N.Y.

[73] Assignee: Eastman Kodak Company, Rochester, N.Y.

[21] Appl. No.: 381,803

[22] Filed: Feb. 1, 1995

[51] Int. Cl.[6] ..... G03C 1/00; G03C 3/00; G03C 1/76

[52] U.S. Cl. ..... 430/496; 430/523; 430/531; 430/539; 430/950; 430/961

[58] Field of Search ..... 430/523, 950, 430/531, 539, 961

[56] References Cited

U.S. PATENT DOCUMENTS

| | | | |
|---|---|---|---|
| 4,092,168 | 5/1978 | Lemahieu et al. | 430/510 |
| 4,232,117 | 11/1980 | Naoi et al. | 430/539 |
| 4,820,615 | 4/1989 | Vandenabeele et al. | 430/523 |
| 4,975,363 | 12/1990 | Cavallo et al. | 430/523 |
| 5,061,595 | 10/1991 | Gingello et al. | 430/523 |
| 5,104,777 | 4/1992 | Schmidt et al. | 430/523 |
| 5,175,073 | 12/1992 | Gingello et al. | 430/523 |
| 5,441,860 | 8/1995 | Fornasari et al. | 430/523 |
| 5,447,832 | 9/1995 | Wang et al. | 430/523 |

FOREIGN PATENT DOCUMENTS

| | | |
|---|---|---|
| 0322247 | 11/1992 | Japan . |
| 6/118542 | 4/1994 | Japan . |

*Primary Examiner*—Charles L. Bowers, Jr.
*Assistant Examiner*—J. Pasterczyk
*Attorney, Agent, or Firm*—Robert A. Gerlach

[57] ABSTRACT

An imaging element comprising a support, at least one hydrophilic light-sensitive layer and at least one protective overcoat layer containing a binder and permanent matte particles, the permanent matte particles having a size distribution of a first mode and a second mode, the first mode being organic particles having a median size of from 0.2 to 1.2 micrometers in a coating weight of from 10 to 200 $mg/m^2$, the said second mode being particles having a mean particle size of from 1.5 to 10 micrometers in a coating weight of from 25 to 150 $mg/m^2$, the total coating weight of particles of the first and second modes being greater than 100 $mg/m^2$.

14 Claims, No Drawings

PHOTOGRAPHIC ELEMENTS CONTAINING MATTE PARTICLES OF BIMODAL SIZE DISTRIBUTION

FIELD OF THE INVENTION

This invention relates to imaging elements and more particularly to photographic imaging elements with improved blocking resistance and in particular favorable storage and handling characteristics in cartridges after processing.

BACKGROUND OF THE INVENTION

It is conventional to incorporate finely powdered grains or matting agents into the protective layer of a photographic element to increase the surface roughness so as to reduce self-adhering of the material, to reduce sticking of the material to manufacturing and processing devices, to improve the antistatic properties of the material, and to improve the vacuum adhesiveness of the material in contact exposure to prevent Newton's rings. The matting agents are commonly very small particles of organic or inorganic materials, such as silicon dioxide, magnesium oxide, titanium dioxide, calcium carbonate, poly(methyl methacrylate), poly(vinyltoluene), poly(methyl methacrylate-co-methacrylic acid), and so on.

This "matting" of the surface layer suffers, however, from various disadvantages. For example, it reduces the transparency of the photographic elements after processing and increases the graininess of the picture. This limits the amount and size of matte which can be incorporated into the protective overcoat. Many attempts therefore have been made to find processing removable polymer particles (soluble matte) which can be removed from the surface during processing, for example, in high pH processing solutions. The high concentration of processing removable matte is needed especially when the photographic elements are used at relatively high levels of moisture and at relatively elevated temperature of from 30° to 40° C. It is also needed to prevent adverse photographic effects, such as desensitization or hypersensitization, when the materials are rolled up.

However, the use of a high level of processing removable matte does not prevent photographic elements from ferrotyping or blocking after processing. This has become important in recent years as more and more processed photographic elements are stored or housed in cartridges with which they come into direct contact. Moreover, the use in the protective overcoat of a higher level of processing removable polymer mattes which contain carboxylic acid groups tends to cause self damage of the photographic elements by scratching or abrading the surface on the opposite side, and to cause damage to manufacturing and finishing apparatus. Therefore, it is desirable to use a minimum amount of processing removable matte in the protective layers of photographic elements even for ferrotyping protection in the raw (unprocessed) state.

The present invention provides a photographic element with good ferrotyping performance both before and after processing, thus allowing the element to be used under harsh application conditions with superior performance, and in particular after processing with favorable handling and storage.

SUMMARY OF THE INVENTION

In accordance with the present invention, an imaging element comprises a support, at least one hydrophilic light-sensitive layer, and at least one protective overcoat layer, contains a binder and permanent matte particles. The permanent matte particles are composed of a size distribution of a first mode and a second mode, with the first mode being composed of organic particles having a mean particle size of from 0.2 to 1.2 micrometers in a coating weight of 10 to 200 mg/m$^2$, and the second mode having a mean particle size of from 1.5 to 10 micrometers in a coating weight of 5 to 150 mg/m$^2$, the total coating weight of the particles of the first and second modes being greater than 100 mg/m$^2$.

The photographic elements in accordance with this invention demonstrate improved ferrotyping and blocking protection at high temperatures and humidities, reduced surface haze and print graininess, and favorable handling and storage in cartridges after processing.

DETAILED DESCRIPTION OF THE INVENTION

This invention contemplates imaging elements having a support, at least one light-sensitive layer, generally silver halide, and a protective layer located further from the support than the light-sensitive layer. The protective layer includes permanent matte particles having a heterogeneous size distribution in a particular bimodal distribution. The measurement and interpretation of particles with such bimodal size distribution have been described in detail by, for example, R. R. Irani and C. F. Callis (*Particle Size: Measurement, Interpretation, and Application*, John Wiley & Sons, Inc. 1963), and J. M. Dallavalle, C. Orr, and H. G. Blocker (*Ind. Eng. Chem.*, 43, 1377, (1951)).

The imaging elements in accordance with this invention can be applied to any suitable support such as, for example, those described in Section XV of *Research Disclosure* No. 36544, September 1994, and in U.S. Pat. 5,284,714, incorporated herein by reference.

It is apparent to those skilled in the art that the photographic element described herein may be exposed in either a conventional reloadable camera or a prepackaged photographic unit, also known as a Single Use Camera.

While the invention is applicable to all types of imaging elements, such as, thermal imaging elements, photothermographic imaging elements, vesicular elements, and the like, the invention is particularly applicable for use in photographic elements which, for the purpose of simplicity of explanation, will be referred to hereinafter.

Matte particles of the present invention can be of any shape. The mean diameter of a particle is defined as the diameter of a spherical particle of identical volume. In some embodiments, it may be preferable to have matte particles that are in the form of spherical beads having diameters in the size ranges described above.

Organic polymeric materials which may comprise matte particles of the first mode include cellulose esters, cellulose ethers, starches, addition-type polymers and interpolymers prepared from ethylenically unsaturated monomers such as acrylates including acrylic acid, methacrylates including methacrylic acid, acrylamides and methacrylate amides, itaconic acid and its half esters and diesters, styrenes including substituted styrenes, acrylonitriles, and methacrylonitriles, vinyl acetates, vinyl ethers, vinyl and vinylidene halides and olefins. In addition, crosslinking and grafting monomers such as 1,4-butyleneglycol methacrylate, trimethylolpropane triacetate, allyl methacrylate, diallyl phthalate, divinyl benzene, and the like may be used. Other polymers that may comprise matting particles of the first mode include condensation polymers such as polyurethanes, polyesters, polyamides, epoxies, and the like. The particles of the first mode have a mean particle size of from 0.2 to 1.2μm, preferably from 0.5 to 1.2μm and most preferably 0.7 to 1.2μm. The particles of the first mode are present in the protective layer in a coverage of 10 to 200 mg/m$^2$, preferably 30 to 170 mg/m$^2$, and most preferably 50 to 150 mg/m$^2$.

The matte particles of the first mode can be prepared by pulverizing and classifying organic compounds, by emulsion, suspension, or dispersion polymerization of organic monomers, by spray drying of a solution containing organic compounds, and by a polymer suspension technique which consists of dissolving an organic material in, for example, a water immiscible solvent, dispersing the solution as fine liquid droplets in aqueous solution, and removing the solvent by evaporation or other suitable techniques. The bulk, emulsion, dispersion, and suspension polymerization procedures are well known to those skilled in the polymer art and are taught in such textbooks such as G. Odian in *Principles of Polymerization,* 2nd Ed., Wiley (1981), and W. P. Sorenson and T. Campbell in *Preparation Method of Polymer Chemistry,* 2nd Ed., Wiley (1968). Suitable stabilizers or dispersing aids can be used in these processes. For example, steric stabilizer, when used in the aqueous media, may include poly(vinyl alcohol), poly(acrylic acid) and its salt, poly(methacrylic acid) and its salt, poly(vinyl pyrrolidone), styrene-maleic acid copolymers, vinyl methyl ether-maleic acid copolymers, sodium alginate, water soluble cellulose derivatives and the like.

Suitable materials for matte particles of the second mode include both organic and inorganic materials, such as inorganic particles including silicone dioxide, barium sulfate, desensitized silver halide, zinc particles, calcium carbonate, and the like; organic polymeric particles, such as, cellulose esters, cellulose ethers, starches; addition-type polymers and interpolymers prepared from ethylenically unsaturated monomers such as acrylates including acrylic acid, methacrylates including methacrylic acid, acrylamides and methacrylate amides, itaconic acid and its half esters and diesters, styrenes including substituted styrenes, acrylonitriles, and methacrylonitriles, vinyl acetates, vinyl ethers, vinyl and vinylidene halides and olefins. In addition, crosslinking and grafting monomers such as 1,4-butyleneglycol methacrylate, trimethylolpropane triacetate, allyl methacrylate, diallyl phthalate, divinyl benzene, and the like may be used. Other polymers that may comprise matting particles of the second mode include condensation polymers such as polyurethanes, polyesters, polyamides, epoxies, and the like. Particles useful for matte particles of the second mode are described in further detail *Research Disclosure* No. 308, published December 1989, pages 1008–1009. The particles of the second mode have a mean particle size of from 1.5 to 10μm, preferably from 1.5 to 5μm, and most preferably from 1.5 to 3μm. The particles of the second mode are present in the protective layer in a range of from 25 to 150 mg/m$^2$, preferably from 25 to 120 mg/m$^2$, and most preferably from 50 to 100 mg/m$^2$.

In the present invention, the permanent matte particles are added to a light-sensitive protective layer. The protective layer may comprise two or more layers. The matte particles of the present invention can be added to any one of these layers. However, it is preferred to add them to the uppermost layer, with the overall coated amount being above 100 mg/m$^2$. It is further preferred that the thickness of the uppermost layer be less than the mean particle size of the second mode.

The protective layer or layers may be disposed over the light-sensitive emulsion layers or on the opposite side of the support than the emulsion layers.

When either of particles is polymeric in nature, it may include reactive functional groups which form covalent bonds with binders by intermolecular crosslinking or by reaction with a crosslinking agent (i.e., a hardener). Suitable reactive functional groups include: hydroxyl, carboxyl, carbodiimide, epoxide, aziridine, vinyl sulfone, sulfinic acid, active methylene, amino, amide, allyl, and the like. There is no particular restriction on the amount of reactive groups present, but their concentrations are preferably in the range of from 0.5 to 10 weight percent. The particle surface may be surrounded with a layer of colloidal inorganic particles as described in U.S. Pat. No. 5,288,598, or a layer of colloidal polymer latex particles which have affinity with suitable binders as described in U.S. Pat. No. 5,279,934, or a layer of gelatin as described in U.S. Pat. No. 4,855,219. A preferred method of making matte particles used in accordance this invention is set forth in U.S. patent application Ser. No. 08/330,406, filed Oct. 28, 1994, entitled "The Process for Making Photographic Polymeric Matte Bead Particles", assigned to the same assignee as this application.

Both types of matte particles useful in the present invention can contain porous structures. The surface area of the matting agent varies but is preferably above 400 m2/g. The pore size in terms of average diameter can be any size but preferably less than 200 A. Known methods which can be used for the preparation of the porous matting agents useful in the present invention have been described, for example, in U.S. Pat. Nos. 2,459,903; 2,505,895; 2,462,798; 3,066,092; 1,665,264; 2,469,314; 2,071,987; and 2,685,569. Both types of matting agents can also be dyed or pigmented as illustrated in U.S. Pat. No. 4,171,737.

Processing removable mattes can be used in the practice of this invention to further enhance the resistance of the pre-processed element to ferrotyping and blocking. Such mattes include particles of, for example, copolymers of alkyl (meth)acrylates and methacrylic acid, or acrylic acid, or itaconic acid, copolymers of alkyl (meth)acrylates and maleic monoesters or monoamides, copolymers of styrene or vinyl toluene and α,β-unsaturated mono- or di-carboxylic acids, or dicarboxylic monoesters or monoamides. Graft copolymers containing maleic anhydride or methacrylic acid, and dicarboxylic acid mono-ester of a cellulose derivative, such as phthalate and hexahydrophthalate of methyl cellulose, hydroxyethyl cellulose, or hydroxypropylomethyl cellulose. Such processing soluble mattes are described in further detail in U.S. Pat. Nos. 2,992,101; 3,767,448; 4,094,848; 4,447,525; and 4,524,131.

Any suitable binder can be used in practice of the present invention including hydrophilic colloids, such as, gelatin as well as hydrophobic polymer resin binders. While the actual amount of binder coated in order to achieve desirable surface physical properties will vary depending on the size and amount of each type of matte particle, the binder is preferably coated at less than about 3 g/m$^2$ to provide surface roughness and greater than 0.2 g/m$^2$ to provide effective adhesion of the matte particles to the surface of the element.

Suitable hydrophilic binders include both naturally occurring substances such as proteins, protein derivatives, cellulose derivatives (e.g., cellulose esters), gelatins and gelatin derivatives, polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyrridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl acrylate and methacrylates, vinyl imidazole copolymers, vinyl sulfide copolymers, homopolymer or copolymers containing styrene sulfonic acid, and the like.

Useful resin binders include polyurethane (e.g., Neorez R960 sold by Zeneca), cellulose acetates (e.g., cellulose diacetate, cellulose acetate butyrate, cellulose acetate propionate), poly(methyl methacrylate), polyesters (e.g., Vitel R sold by Goodyear Tire & Rubber Co.), polyamides (e.g., Unirez sold by Union Camp, Vesamide sold by General Electric Co.), polycarbonates (e.g., Makrolon sold by Mobay Chemical Co., Lexan sold by General Electric Co.), polyvinyl acetate, and the like.

The binder should be chosen so that it effectively adheres the matte particles to the surface of the element. For crosslinkable binders such as gelatin and polyurethane, the binder is preferably cross-linked so as to provide a high degree of adhesion. Crosslinking agents or hardeners which may effectively be used in the coating compositions of the present invention include aldehydes, epoxy compounds, polyfunctional aziridines, vinyl sulfones, methoxyalkyl melamines, triazines, polyisocyanates, dioxane derivatives such as dihydroxydioxane, carbodiimides, chrome alum, zirconium sulfate, and the like.

The protective layer useful in the practice of the invention may optionally contain surface active agents, charge control agents, antistatic agents, thickeners, ultraviolet ray absorbers, processing removable dyes, high boiling point solvents, silver halide particles, colloidal inorganic particles, magnetic recording particles, slip agents, additional matting agents, polymer latexes, and various other additives.

The protective layer useful in the practice of the invention can be applied in any of a number of well-known techniques, such as dip coating, rod coating, blade coating, air knife coating, gravure coating, and reverse roll coating, extrusion coating, slide coating, curtain coating, and the like. The matte particles and the binder are preferably mixed together in a liquid medium to form a coating composition. The liquid medium may be a medium such as water or other aqueous solution in which hydrophilic colloids are dispersed with or without the presence of surfactants, or it may be a solvent such as an organic solvent in which the resin binder (but not the matte particles) is dissolved. After coating, the protective layer is generally dried by simple evaporation, which may be accelerated by known techniques such as convection heating. Known coating and drying methods are described in further detail in *Research Disclosure* No. 308, Published Dec. 1989, pages 1007 to 1008.

The invention is illustrated by the following examples wherein all of the permanent matte particles were prepared by the general procedure set forth in Preparation 1 of the above-mentioned U.S. Application Serial Number 08/330,406:

EXAMPLE 1 to 8

A series of photographic elements are prepared as follows: A cellulose triacetate film support having an antihalation layer on one side and an antistatic backing layer on the other side (as described below) is coated on the antihalation layer with the following image forming layers in sequence (U.S. Pat. No. 5,288,598): a slow cyan dye-forming layer, a fast cyan dye-forming layer, an interlayer, a slow magenta dye-forming layer, a fast magenta dye-forming layer, an interlayer, a slow yellow dye-forming layer, a fast yellow dye-forming layer, and a UV layer.

The antistatic backing layer is coated with 143 mg/m$^2$ cellulose acetate, 72 mg/m$^2$ poly(vinyl benzyl chloride-co-ethylene glycol diacrylate) quanteranized with triethyl amine, and 21.5 mg/m$^2$ carnauba wax.

A protective layer containing gelatin binder is coated on the top of the UV layer and has a composition listed in Table 1.

TABLE I

| Composition of the Protective Layer | |
|---|---|
| a. Gelatin, Type IV | 888 mg/m$^2$ |
| b. Silicone lube, DC-200 (Dow Corning) | 40.1 mg/m$^2$ |
| c. Fluorad FC-134 | 3.9 mg/m$^2$ |
| d. Aerosol OT | 21.5 mg/m$^2$ |
| e. Surfactant Olin 10 G | 27.2 mg/m$^2$ |
| f. Matte 2, Poly(vinyl toluene-co-divinyl benzene) 80:20 ratio, 1.5 μm | in Table 2 |
| g. Matte 1, Poly(vinyl toluene-co-divinyl benzene) 80:20 ratio, 0.45 μm | in Table 2 |

The ferrotyping performance is evaluated in the following manner: 12" by 35 mm strips of film, either raw or processed, and leader are conditioned to desired RH at 70° F. for 17 hours. The leader is then wound under 24 oz. tension onto a reel and pairs of test strips are wound between laps of the leader. The reel is then packaged in a vapor proof bag and held at the desired temperature for 1 or 3 days. Following the hold, the leader is unwounded, the strips are removed and visually evaluated for ferrotyping. The following scale is used:

| Value | % of Area Showing Ferrotyping |
|---|---|
| A | 0 |
| B | >0 to <5 |
| C | 5 to <20 |
| D | 20 to <50 |
| E | 50 to 100 |

The graininess of a photographic picture is caused by the developed grain and dispersions and in particular matting agent in the protective layers. The Root Mean Square (RMS) Granularity is evaluated by the method described in ANSI Ph 2.40 (1985) entitled "Root Mean Square (RMS) Granularity of Film (Images on One Side Only)-Method for Measurement" The test results are reported in Table II.

TABLE II

| Example No. | Matte 2, 1.5 mm mg/m² | Matte 1, 0.45 mm mg/m² | Insert Ferrotyping 120° F./70% RH/2 days Raw Near Core | Near out | Processed | RMS (Graininess) |
|---|---|---|---|---|---|---|
| 1 (Comp.) | 0 | 80.7 | E | E | E | −1 |
| 2 (Comp.) | 80.7 | 0 | C | C | D | 2.0 |
| 3 (Inv.) | 80.7 | 80.7 | B | B | C | 1.5 |
| 4 (Inv.) | 80.7 | 161.5 | B | B | C | 2.5 |
| 5 (Inv.) | 33.4 | 114.1 | C | C | D | 0.5 |
| 6 (Inv.) | 114.1 | 33.4 | B | B | C | 2.5 |
| 7 (Inv.) | 114.1 | 114.1 | B | B | C | 2.5 |
| 8 (Comp.) | 161.5 | 80.7 | B | B | C | 4.0 |

As can be seen from the Table, the samples according to the present invention result in a significant improvement in the ferrotyping properties both before and after processing with acceptable printing RMS granularity values. Both present invention Example 4 and Comparison Example 8 contain the same amount of total matting agents (i.e. 242.2 mg/m2), and have similar ferrotyping properties. However, comparison Example 8 indicates that the use of a higher level of larger permanent matte (>150 mg/m²) leads to unacceptable printing RMS granularity.

EXAMPLE 9 to 17

The photographic elements in these examples are prepared as described above except the protective layer composition is as set forth in Table 3.

TABLE III

| Composition of the Protective Layer | |
|---|---|
| a. Gelatin, Type IV | 888 mg/m² |
| b. Silicone lube, DC-200 (Dow Corning) | 39.1 mg/m² |
| c. Fluorad FC-134 | 3.9 mg/m² |
| d. Aerosol OT | 21.5 mg/m² |
| e. Surfactant Olin 10 G | 27.3 mg/m² |
| f. Matte 2, Poly(vinyl toluene-co-divinyl benzene) 80:20 ratio, 1.5 μm | in Table 4 |
| g. Matte 1, Poly(vinyl toluene-co-divinyl benzene) 80:20 ratio, 0.75 μm | in Table 4 |
| h. Matte 3, Poly(methyl methacrylate-co-methacrylic acid) 45:55, 2.7 μm | 107.6 mg/m² |

The coating ferrotyping performance and printing RMS granularity are evaluated in the same manner as described above, and the results are listed in Table 4.

The results, compiled in Table 4, demonstrate excellent ferrotyping protection properties of the samples according to the present invention in combination with the use of processing removable matte (Matte 3) in the protective layers. For example, comparative Example 9 contains only soluble matte and larger permanent matte, and shows inferior ferrotyping protections both before and after processing. The use of matte combinations according to the present invention results in a significant improvement on ferrotyping performance (e.g., Example 12) without any significant change in the film RMS printing granularity.

TABLE IV

| Example No. | Matte 2 mg/m² | Matte 1 mg/m² | Matte 3 mg/m² | Insert Ferrotyping Raw 100° F./ 70% RH 17 Hrs. | Raw 100° F/ 80% RH 17 Hrs. | Raw 120° F./ 70% RH 3 Days | Processed 120° F. 70% RH 3 Days | RMS (Graininess) |
|---|---|---|---|---|---|---|---|---|
| 9 (Comp.) | 53.8 | 0 | 107.6 | B | E | C | E | 1 |
| 10 (Inv.) | 53.8 | 53.8 | 107.6 | B | C | B | D | 1 |
| 11 (Inv.) | 53.8 | 107.6 | 107.6 | B | C | B | D | 1 |
| 12 (Inv.) | 53.8 | 161.5 | 107.6 | B | B | B | C | 1 |
| 13 (Inv.) | 26.9 | 161.5 | 107.6 | B | B | B | C | 0 |
| 14 (Comp.) | 80.7 | 0 | 107.6 | B | D | C | D | 1 |
| 15 (Inv.) | 80.7 | 53.8 | 107.6 | B | C | B | D | 1.5 |
| 16 (Inv.) | 80.7 | 107.6 | 107.6 | B | C | B | C | 1.5 |
| 17 (Inv.) | 80.7 | 161.5 | 107.6 | B | B | B | C | 1.5 |

The photographic processing steps to which the raw film may be subject may include, but are not limited to the following:

1.) color developing→bleach-fixing→washing/stabilizing;

2.) color developing→bleaching→fixing→washing/stabilizing;

3.) color developing→bleaching→bleach-fixing→washing/stabilizing;

4.) color developing→stopping→washing→bleaching→washing→fixing→washing/stabilizing;

5.) color developing→bleach-fixing→fixing→washing/stabilizing;

6.) color developing÷bleaching→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

What is claimed is:

1. An imaging element comprising a support, at least one hydrophilic light-sensitive layer and at least one protective overcoat layer containing a binder and permanent matte particles, the permanent matte particles having a size distribution of a first mode and a second mode, the first mode being organic polymer particles having a mean size of from 0.2 to 1.2 micrometers in a coating weight of from 10 to 200 mg/m$^2$, the said second mode being particles having a mean particle size of from 1.5 to 10 micrometers in a coating weight of from 25 to 150 mg/m$^2$, the coating weight of particles of the first and second modes in total being greater than 100 mg/m$^2$.

2. The imaging element of claim 1 wherein the mean particle size of the organic polymer particles of the first mode is from 0.5 to 1.2 micrometers.

3. The imaging element of claim 1 wherein the mean particle size of the organic polymer particles of the first mode is from 0.7 to 1.2 micrometers.

4. The imaging element of claim 1 wherein the coating weight of the organic polymer particles of the first mode is from 30 to 170 mg/m$^2$.

5. The imaging element of claim 1 wherein the coating weight of the organic polymer particles of the first mode is from 50 to 150 mg/m$^2$.

6. The imaging element of claim 1 wherein the mean particle size of the particles of second mode is from 1.5 to 5 micrometers.

7. The imaging element of claim 1 wherein the mean particle size of the particles of the second mode is from 1.5 to 3 micrometers.

8. The imaging element of claim 1 wherein the coating weight of the particles of the second mode is from 25 to 120 mg/m$^2$.

9. The imaging element of claim 1 wherein the coating weight of the particles of the second mode is from 50 to 100 mg/cm$^2$.

10. The imaging element of claim 1 wherein the light-sensitive layer contains silver halide particles.

11. The imaging element of claim 1 wherein the protective overcoat layer is on the same side of the support as the light-sensitive layer and is further from the support than the light-sensitive layer.

12. The imaging element of claim 1 wherein the protective overcoat layer is on the opposite side of the support than the light-sensitive layer.

13. The imaging element of claim 1 wherein the protective overcoat layer also contains a processing removable matte.

14. The imaging element of claim 1 wherein the thickness of the uppermost layer of the protective overcoat layer is less than the mean particle size of the second mode of the permanent matte particles.

* * * * *